United States Patent [19]

Minamiyama et al.

[11] Patent Number: 4,485,595

[45] Date of Patent: Dec. 4, 1984

[54] GRINDING AND POLISHING APPARATUS

[75] Inventors: Toshimasa Minamiyama, Amagasaki; Haruo Arahori, Yamatotakada, both of Japan

[73] Assignee: Fuji Kuuki Kabushiki Kaisha, Osaka, Japan

[21] Appl. No.: 501,244

[22] Filed: Jun. 6, 1983

[30] Foreign Application Priority Data

Aug. 31, 1982 [JP] Japan ..... 57-151963

[51] Int. Cl.[3] ..... B24B 49/16

[52] U.S. Cl. ..... 51/165.92; 51/134.5 F; 51/168; 29/568

[58] Field of Search ..... 51/168, 134.5 R, 134.5 F, 51/165.77, 165.92; 29/568

[56] References Cited

U.S. PATENT DOCUMENTS

| | | | |
|---|---|---|---|
| 2,947,121 | 8/1960 | Coes | 51/134.5 R |
| 3,827,834 | 8/1974 | Kakimoto | 51/134.5 F |
| 3,947,951 | 4/1976 | Ierue | 29/568 |
| 3,965,622 | 6/1976 | Stepanek | 51/134.5 R |
| 4,077,736 | 3/1978 | Hutchens | 51/134.5 R |
| 4,118,900 | 10/1978 | Moritomo | 51/165.77 |

*Primary Examiner*—Harold D. Whitehead

*Attorney, Agent, or Firm*—Armstrong, Nikaido, Marmelstein & Kubovcik

[57] ABSTRACT

A grinding and polishing apparatus wherein an air grinder is incorporated in the tool attaching spindle of a machining center main body in exactly the same manner as in the other exchange tools so that grinding and polishing operations can be performed. The tool attaching spindle is centrally formed with a tool mounting bore and a compressed air feed passage. The air grinder is attached to the tool mounting bore and driven by fluid being fed from the compressed air feed passage. The apparatus further includes air feed control means, whereby supply of fluid to the compressed air feed passage is started after the base portion of the air grinder is mounted in the tool mounting bore and supply of fluid is stopped immediately before the air grinder is removed from the tool mounting bore.

3 Claims, 7 Drawing Figures

GRINDING AND POLISHING APPARATUS

BRIEF SUMMARY OF THE INVENTION

This invention relates to a grinding and polishing apparatus and particularly to a grinding and polishing apparatus incorporating an air grinder in a spindle as a tool in a machining center to perform grinding and polishing operations.

Machine tools of the type, called a machining center, in which with the object of increasing productivity in machine work and promoting labor-saving in factories, such as manless operation, a single machine tool is used which is designed to automatically exchange tools successively in machining order in accordance with a preset program without the need to mount and dismount a workpiece in the process of a series of machining steps, to thereby handle a number of machining steps, are being extensively used. Conventional machine tools of this type mainly employ a system for performing cutting operations using cutters by mounting on and dismounting from the spindle such rotary cutters as milling cutters and drills. Of course, most of the machining of workpieces is high speed machining by cutting and almost all required machining operations can be performed simply by fixing a workpiece on the table, so that it might be said that the intended object can be attained somehow.

However, in order to provide for increased machining accuracy and labor-saving, it is desirable that not only cutting by cutters but also grinding and polishing operations can be incorporated in a program so that such additional operations can be perfored in conjunction with the aforesaid cutting operations.

Accordingly, a principal object of the present invention is to provide a grinding and polishing apparatus, in a machining center, which is capable of mounting an air grinder in the same manner as in conventional cutters to enable grinding and polishing operations to be perfored irrespective of the configurations and regions of workpieces to be machined and which is capable of automatic exchange of grinding and polishing tools in the same manner as in the other tools.

Another object of the invention is to provide a grinding and polishing apparatus in which whether machining is to be performed by the rotation of an air grinder alone or by the resultant of the rotations of an air gridner and a tool attaching spindle can be selectively determined to make it possible to obtain an optional rotative speed of the grinding wheel which satisfies conditions for grinding or polishing by the grinder.

A further object of the invention is to provide a grinding and polishing apparatus adapted to detect the load condition of the air grinder during operation to control the feed speed of the tool attaching spindle of the machining center main body according to the detected load condition, thereby ensuring that grinding and polishing operations are performed in proper load condition at all times.

A grinding and polishing apparatus which meets said objects comprises a machining center main body, a tool attaching spindle secured to said machining center main body and having a tool mounting bore in the middle and a passage communicating with said tool mounting bore for feeding compressed air to drive an air grinder, said air grinder having a base portion shaped to fit in said tool mounting bore and to be thereby attached to the latter and adapted to be driven by fluid being fed from said compressed air feed passage, and air feed control means for starting supply of fluid to said compressed air feed passage after the base portion of said air grinder is fitted in said tool attaching bore and stopping said supply of fluid immediately before the air grinder is removed from said tool mounting bore.

Thus, according to this apparatus, an air grinder can be incorporated as an exchange tool in addition to conventional cutting tools, thus enlarging the machining range, and since grinding and polishing can be performed without the need to mount and dismount a workpiece with respect to the table, accurate machining can be easily performed.

In a preferred embodiment of the invention, the grinding and polishing apparatus has a drive control device which is characterized by selectively determining whether machining is to be performed by the rotation of the air grinder alone with the rotation of the tool attaching spindle stopped or by the resultant of the rotations of the air grinder and said tool attaching spindle and giving instructions concerning such selection to the aforesaid machining center main body.

As a result, it becomes possible to obtain an optional rotative speed of the grinding wheel satisfying conditions for grinding or polishing by the grinder and hence to set more accurate conditions for grinding and polishing.

Further, in another preferred embodiment of the invention, said apparatus has a feed speed control device which comprises detecting means for detecting the rotative speed of the air grinder spindle during operation, memory means for storing a reference rotative speed, comparing means for comparing the rotative speed of the spindle detected by said detecting means with the reference rotative speed and emitting a signal on the basis of the result of the comparision, and control means for controlling the feed speed of the tool attaching spindle of the machining center main body on the basis of the signal from said comparing means.

As a result, it becomes possible to perform grinding under proper load condition at all times by controlling the feed speed of the tool attaching spindle of the machining center main body in accordance with the load condition of the air grinder.

Other features and merits of the invention will become apparent from the following description to be given with reference to the accompanying drawings.

DETAILED DESCRIPTION

Embodiments of the invention will now be described in detail with reference to the drawings.

Figure 1:
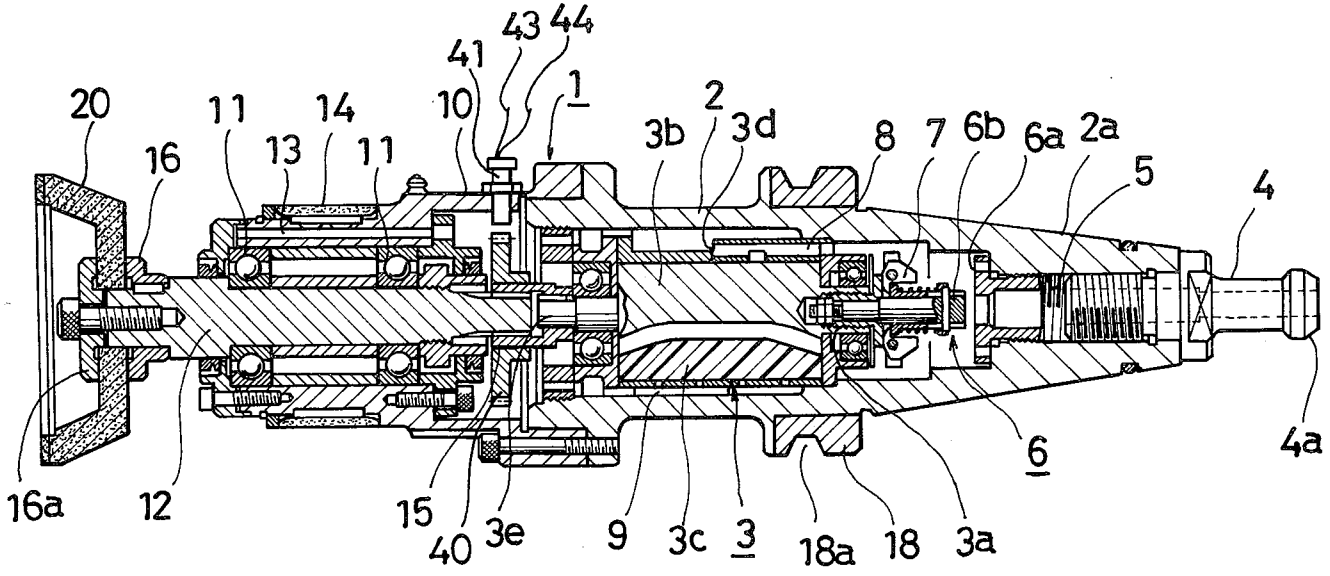
FIG. 1 is a longitudinal section showing an embodiment of an air grinder unit used in a machining center in the apparatus of the present invention.

FIG. 1 shows a concrete example of an air grinder 1 to be mounted to the spindle of a machining center main body. The numeral 2 denotes a main body having a motor section 3 in the front half, the outer periphery 2*a* of the rear half being tapered in conformity with the taper bore of the tool attaching spindle of the machining center main body so that it can be mounted thereto. The numeral 4 denotes an air feed connector pipe whose front end is threadedly inserted into a threaded hole 5 formed centrally in the main body 2 and whose rear end 4*a* is adapted to be air-tightly engaged with the inner wall surface of the compressed air feed passage in the tool attaching spindle of the machining center main body.

The numeral 6 denotes an air feed valve which comprises valve seat 6*a* threadedly inserted into the threaded hole 5, and a valve 6*b* having a governer 7 attached to the motor shaft 3*a*, said air feed valve being adapted to reduce the degree of opening of the air feed portion or close it if the rotative speed exceeds a preset value. Further, 3*b* denotes the rotor of the motor; 3*c* denotes blades; 3*d* denotes an air cylinder; 8 denotes an air feed passage; 9 denotes an exhaust passage; and 3*e* denotes the output shaft of the motor. The numeral 10 denotes a spindle support casing fitted on the front end of the main body 1 and rotatably supporting a spindle 12 coaxially with the motor output shaft 3*e* by means of bearings 11 installed therein. The casing 10 is internally provided with a communicating hole 13 and a space communicating with the exhaust passage 9 of the motor 3 contained in the main body 2, so that the exhaust air, after driving the motor, can be dissipated outside through a porous cover ring 14 of suitable thickness fitted on said casing. The spindle 12 is coaxially connected at its rear end to the output shaft 3*e* by a coupling 15 and has a bowl-shaped grinding wheel (to which the invention is not limited) held thereon as it is clamped between a support plate 16 and a keep plate 16*a*. Fixedly fitted on the base portion of the main body 2 is a tool exchange clamp having a V-shaped annular groove 18*a* cut therein.

Figure 2:
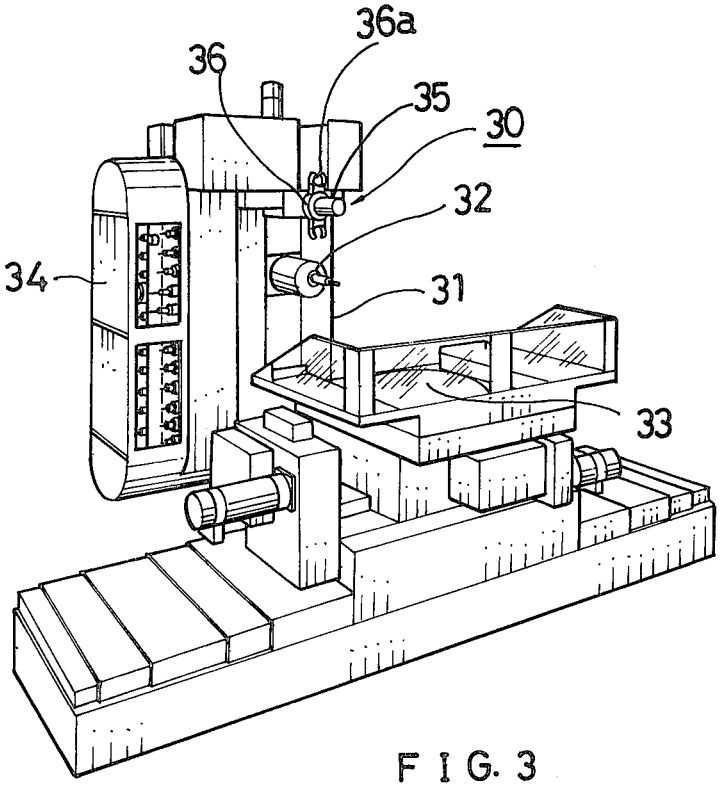
FIG. 2 is a perspective view of an embodiment of the apparatus of the invention.
Figure 3:
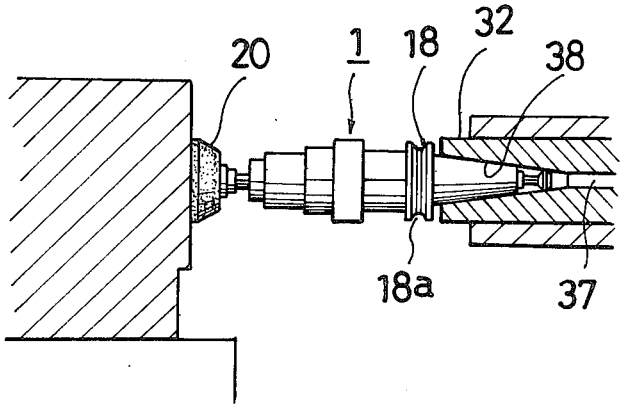
FIG. 3 is a view illustrating the apparatus of the invention in operation.

When the air grinder 1 of such construction is to be used, e.g., in a horizontal machining center 30 shown in FIG. 2, it is stored, when not in use, in a tool locker 34 at a predetermined position in the same manner as for the other tools. A tool attaching spindle 32 horizontally projecting from a main body 31 to lie above a workpiece support table 33 is centrally formed with a compressed air feed hole 37, to which a compressed air pipe extending as from the air line of the factory is connected inside the main body 31 through a rotary joint.

Air feed ontrol means is placed in said pipe. For example, a solenoid valve is installed in the pipe and arranged to open only when the air grinder is used. More particularly, the control circuit of an electric control mechanism is designed so that the clamp holder 36 of a tool exchanger 35 reaches the air grinder take-out position in the tool locker 34, grips it by means of a clamp 36*a* and is moved to the tool attaching spindle 32 in predetermined order to fix it to the front end of said tool attaching spindle 32, whereupon the solenoid valve is opened. As a result, when the air grinder 1 of aforesaid construction is mounted to the tool attaching spindle 32, the motor 3 of the air grinder 3 is started to rotate the grinding wheel 20.

In the apparatus described above, when a workpiece having a portion which is to serve as a slide surface is to be machined, the machining is progressively performed according to a preset program prepared by taking into account the required shape, places to be machined and machining order, with the portion which serves as a slide surface being first cut over a predetermined region by a milling cutter. Thereafter, tool exchange between the milling cutter and the air grinder 1 is effected by known means to mount the air grinder 1 to the holder portion 38 of the tool attaching spindle 32. In so doing, in operative association with the exchange for the air grinder 1, upon completion of the mounting, the air feed control means is actuated, i.e., the valve in the compressed air pipe is opened, feeding compressed air from the air feed connector pipe 4 to the motor 3 within the main body 2 to thereby rotate the motor, so that the grinding wheel 20 is rotated at high speed through the spindle 12 of the grinder directly connected to the motor. Then, the grinding wheel 20 is thrusted by a predetermined grinding amount against the surface of the workpiece. In this case, since the grinding wheel 20 is rotated by the air motor, a greater load will naturally lowers the rotative speed of the grinding wheel from its no-load rotative speed, requiring that the predetermined rotative speed be maintained by adjusting the grinding amount per operation according to the state of the surface being machined and other conditions (material, surface hardness, etc.), but in some cases the rotative speed will be maintained in the following manner: In order to increase the rotative speed, not only the grinder 1 but also the tool attaching spindle 32 having said grinder 1 mounted thereto is rotated so as to rotate the grinding wheel 20 at the resultant of the rotative speeds of the tool attaching spindle 32 and air grinder 1. Thus, since the grinding wheel 20 can be rotated at any desired high speed, grinding operation at high speed becomes possible. In this case, by suitably selecting the particle size of the grinding wheel 20, it is, of course, possible to perform more effective polishing. In addition, if the aforesaid apparatus is provided with a drive control device for selectively determining whether grinding operation is to be effected by the rotation of the air grinder 1 alone with the tool attaching spindle 32 stopped or by the resultant of the rotations of the air grinder 1 and tool attaching spindle 32, as described above, this is convenient since conditions for grinding can be selected within a broader range.

When grinding (or polishing) is thus completed, the air grinder 1 is removed from the holder portion of the spindle 32 by the actuation of the tool exchanger 35 and exchanged for a tool for the next operation. In this case, the air feed conrol means operates as follows: As soon as the completion of operation by the air grinder 1 is ascertained on the basis of the program, said means closes the solenoid valve in the compressed air feed pipe leading to the spindle 32 to stop supply of compressed air to the spindle 32 to thereby avoid interference with the next tool change operation.

The feed speed control device will now be described with reference to FIGS. 4 through 7. This feed control device is designed to detect the load condition of the air grinder during operation and control the feed speed of the tool attaching spindle of the machining center main body so as to ensure that grinding or polishing is performed under proper conditions at all times.

Figure 4:
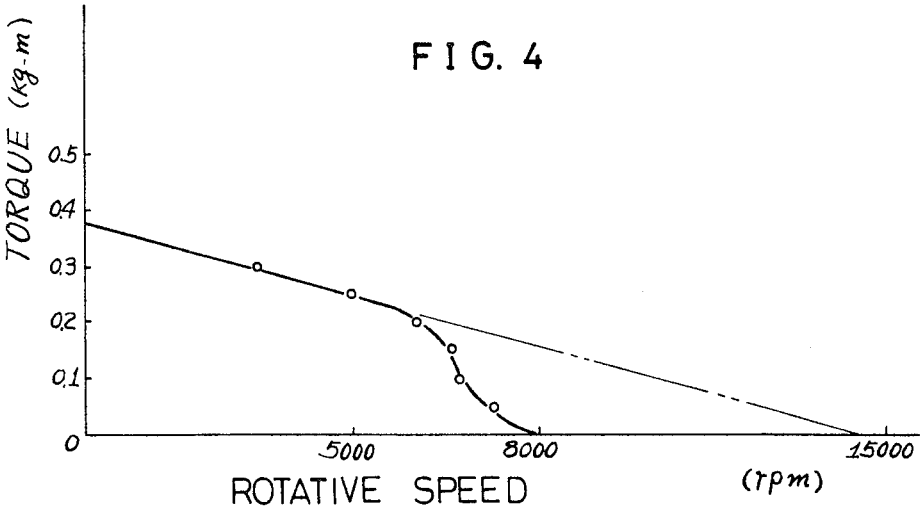
FIG. 4 is a graph showing the relation between the rotative torque and rotative speed of the air grinder.

The load condition of the air grinder, i.e., the torque needed for grinding and the rotative speed of the spindle are correlated so that, as shown in FIG. 4, when the load increases, the rotative speed of the spindle decreases. In this apparatus, therefore, the rotative speed of the spindle is detected in order to detect the load condition of the air grinder.

Figure 5:
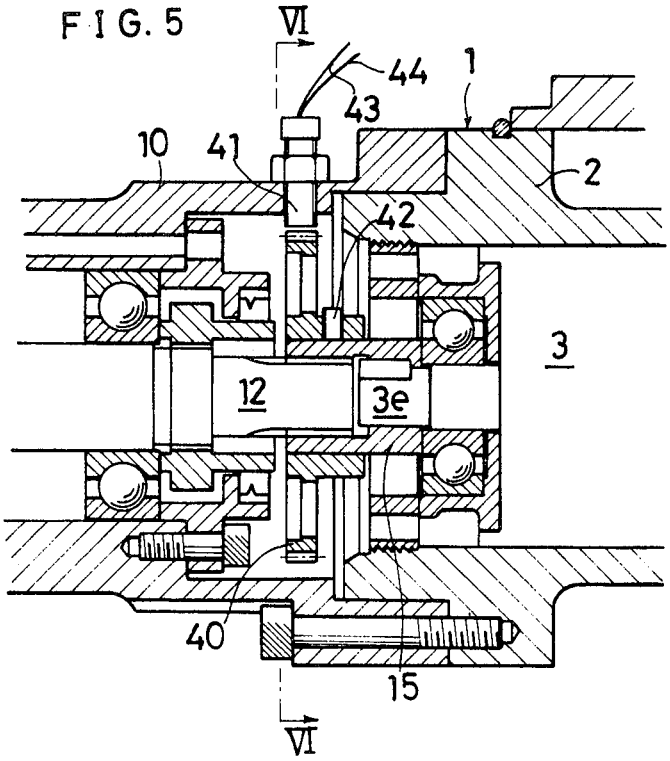
FIG. 5 is an enlarged sectional view showing a region including detecting means in said air grinder unit.
Figure 6:
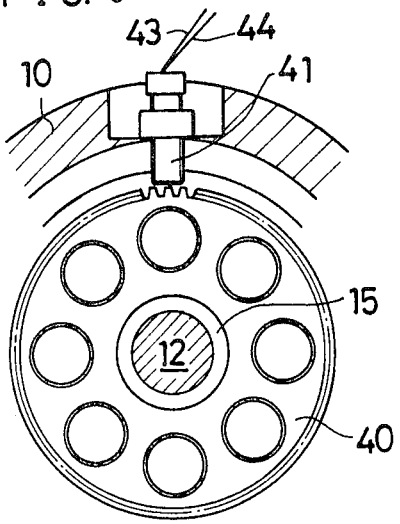
FIG. 6 is a sectional view taken along the line VI—VI in FIG. 5.

An example of detecting means is shown in FIGS. 5 and 6. This detecting means comprises a gear-shaped sensor (gear pulser) 40, and a power-generator type electromagnetic sensor 41. The gear-shaped sensor 40 is fitted on a coupling 15 which interconnects the output shaft 3*e* of the air motor and the spindle 12, and it is fixed thereon by a bolt 42 so as to be rotated with the spindle 12 of the air motor 1. The power-generator type electromagnetic sensor 41 is formed by winding a coil on a permanent magnet, and its front end extends through and into the spindle support casing 10 to be positioned adjacent the outer periphery of said gear pulser 40. Further, from the rear end of the power-generator type sensor 41 located outside said spindle support casing 10, there extend lead wires 43 and 44 which lead signals from said sensor 41 to the machining center main body 30.

In the aforesaid detecting means, the gear-shaped sensor 40 is rotated with the rotation of the spindle 12 of the air grinder 1, with the tips of the teeth moving toward and away from the power-generator type electromagnetic sensor 41 repeatedly, with the result that said power-generator type electromagnetic sensor 41 produces a voltage having a frequency dependent on the rotative speed of the spindle 12. This makes it possible to detect the rotative speed of the spindle 12. As for the detecting means for detecting the rotative speed of the spindle 12, besides the one described above, the gear-shaped sensor 40 may be a permanent magnet while using as said power-generator type electromagnetic sensor 41 a coil having a core inserted therein, or other known detecting means, such as a stroboscope, may be used.

The detection signal is transmitted to the control circuit in the machining center main body through said lead wires 43 and 44 and through unillustrated transformer coupling means. By the transformer coupling is meant a pair of coils each having a core, which are positioned in opposed relation to each other, one at the air grinder and the other at the machining center, so that signals are transferred from one to the other by electromagnetic induction.

Figure 7:
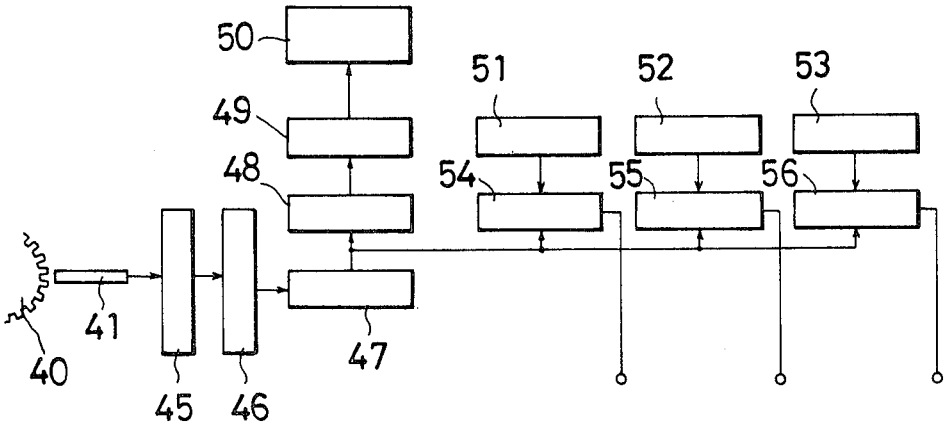
FIG. 7 is a block diagram of a feed speed control device.

The aforesaid detection signal (pulse voltage) is fed to a computer 47 through an amplifying circuit 45 and a waveform shaping circuit 46, as shown in FIG. 7, and in said counter 47, it is controlled by 0.1-sec gating and the number of pulses, i.e., the rotative speed (or a characteristic value which is proportional thereto) is counted. In addition, the result of counting is passed through a latch circuit 48 and a driver circuit 47 and converted to the number of revolutions per sec, which is displayed by a displaying device 50.

On the other hand, the memory means for storing the reference rotative speed is constituted, e.g., of first through third digital switches 51, 52 and 53. There may be cases where only one such digital switch is provided according to the user's conditions for use or a plurality of digital switches are provided, as shown. Rotative speeds (or characteristic values which are proportional thereto) serving as references are inputted into these digital switches 51, 52 and 53. In inputting, for example, a higher deference rotative speed (e.g., 5000 rpm) is set in the first digital switch 51, a medium reference rotative speed (e.g., 4000 rpm) in the second digital switch 52, and a lower reference rotative speed (e.g., 3000 rpm) in the third digital switch 53.

The detected rotative speed of the spindle 12 is compared with the reference rotative speeds in the first through third comparing means 54, 55 and 56. These comparing means 54, 55 and 56 do not produce any output signal when the rotative speed of the spindle is greater than or equal to the respective reference rotative speeds but produce output signals only when the rotative speed of the spindle is lower than the reference rotative speeds. The control means of the machining center acts to lower the feed speed of the tool attaching spindle 32 by perdetermined percent according to said signals.

For example, if the load on the air motor 1 increases for one reason or another to decrease the rotative speed of the spindle 12 of the air motor 1 until it is lower than the higher reference rotative speed (5000 rpm), the signal from the first comparing means 54 causes the machining center to lower the feed speed of the tool attaching spindle 32 by some percent. As a result, if the load decreases and hence the rotative speed of the spindle 12 increases, or if its load condition (i.e., the rotative speed) continues, the grinding or polishing is continued at the decreased feed speed, but if, on the contrary, there is produced no decrease in the load and the rotative speed of the spindle 12 further decreases until it is below the reference rotative speed (4000 rpm) for the second comparing means 55, the signal from the latter causes the machining center to lower the feed speed of the tool attaching spindle 32 by some additional percent. If, with all this procedure, the overload condition still continues, then the third comparing means 55 is likewise actuated to further decrease the feed speed or stop the grinding or polishing operation.

Thus, by detecting the load condition of the air grinder during operation and controlling the feed speed of the tool attaching spindle of the machining center main body according to the detected load condition, it is possible to perform grinding or polishing under proper conditions at all times.

Thus, in the present invention, it is possible to incorporate an air grinder in tool exchange in the machining center and mount it to the holder portion of the spindle in the same manner as in the other tools so as to perform grinding or polishing operation. That is, by simply mounting the air grinder to the holder portion or dismounting it therefrom in the same manner as in the other tools, the air feed control means is actuated and opening and closing of the compressed air feed passage is effected under instructions therefrom, thus automatically effecting connection and disconnection between the grinder 1 and the driving source. Therefore, it is possible to incorporate a grinder in the machining center in a simple arrangement without adding any special mechanism to the machining center main body 30 and to effect tool exchange automatically. As a result, grinding operation, which in the past have had to be performed in a separate step, can be performed in the same step as that of cutting and hence the processing by the machining center can be made more rational. In this case, there is an advantage that even if the load on the grinding wheel 20 becomes excessive, the rotative speed of the air motor simply decreases without causing any trouble to the driving of the motor, which is a safety feature.

Further, where the drive control means is provided, machining can be performed by optionally changing the rotative speed of the grinding wheel 20. That is, since the tool attaching spindle 32 for mounting the air grinder can be caused to change its rotative speed within the range of rotative speed of cutting tools heretofore used in the machining center main body 30, this can be utilized to add to the normal rotative speed of the air grinder while optionally changing the rpm of the tool attaching spindle 32, thus making it possible to optionally select conditions for grinding. Accordingly, the machined surface can be finished to any desired condition.

Further, where the feed control device is provided, since the feed speed of the tool attaching spindle of the machining center main body can be controlled according to the load condition of the air grinder during operation, grinding and polishing operations can be performed under proper load condition at all times.

In addition, according to the gist of the present invention, the invention can be applied to various types of machining centers by making the external shape of the rear end of the air grinder main body conformable to the required taper and to the shape of the grip portion of the tool exchanger.

The invention has been described with reference to preferred embodiments thereof, but it is not limited to said embodiments, it being evident that those skilled in the art may embody the invention in various forms within the scope of the invention.

What is claimed is:

1. A grinding and polishing apparatus comprising a machining center main body, a tool attaching spindle secured to said machining center main body and having a tool mounting bore in the middle and a passage communicating with said tool mounting bore for feeding compressed air to drive an air grinder, said air grinder having a base portion shaped to fit in said tool mounting bore and to be thereby attached to the latter and adapted to be driven by fluid being fed from said compressed air feed passage, and air feed control means for starting supply of fluid to said compressed air feed passage after the base portion of said air grinder is fitted in said tool attaching bore and stopping said supply of fluid immediately before the air grinder is removed from said tool mounting bore.

2. A grinding and polishing apparatus as set forth in claim 1, including a drive control device adapted to selectively determine whether machining is to be performed by the rotation of the air grinder alone with the rotation of said tool attaching spindle stopped or by the resultant of the rotations of said air grinder and tool attaching spindle, and give instructions concerning such selection to said machining center main body.

3. A grinding and polishing apparatus as set forth in claim 1, including a feed speed control device which comprises detecting means for detecting the rotative speed of the air grinder spindle during operation, memory means for storing a reference rotative speed, comparing means for comparing the rotative speed of the spindle detected by said detecting means with the reference rotative speed and emitting a signal on the basis of the result of the comparison, and control means for controlling the feed speed of the tool attaching spindle of the machining center main body on the basis of the signal from said comparing means.

* * * * *